United States Patent [19]

Grimmer et al.

[11] Patent Number: 4,498,788

[45] Date of Patent: Feb. 12, 1985

[54] ESCAPEMENT FOR A TIMER

[75] Inventors: Horst Grimmer, Nurnberg-Oberasbach; Alfred-Günther Lunz, Nuremberg, both of Fed. Rep. of Germany

[73] Assignee: Diehl GmbH & Co., Nuremberg, Fed. Rep. of Germany

[21] Appl. No.: 615,894

[22] Filed: May 31, 1984

[30] Foreign Application Priority Data

Jun. 3, 1983 [DE] Fed. Rep. of Germany ..... 3320242

[51] Int. Cl.[3] ..... G04F 7/00

[52] U.S. Cl. ..... 368/106; 200/35 R

[58] Field of Search ..... 368/97, 98, 101, 106, 368/107-113, 145-146, 124-125, 184-185, 190; 200/37 R, 37 A, 38 R, 38 A, 38 B, 38 FA, 38 FB, 35 R, 36

[56] References Cited

U.S. PATENT DOCUMENTS 4,044,548 8/1977 Rowbottam ..... 368/222

FOREIGN PATENT DOCUMENTS 2915526 10/1980 Fed. Rep. of Germany .

*Primary Examiner*—Vit W. Miska

*Attorney, Agent, or Firm*—Scully, Scott, Murphy & Presser

[57] ABSTRACT

An escapement or directional latching mechanism for a timer which actuates a timing switch component through the intermediary of a driving member, which is manually settable relative to the driving member against a larger moment of resistance in one direction of rotation as in the other direction of rotation. The escapement includes a ring having an internal toothing coupled with the driving member, and a ratchet wheel connected secured fixed against rotation with the timing switch component and which is located coaxially with the ring, with the ratchet wheel including at least two arms located in the plane of the ring, which with a finger thereof engage spring-elastically in the radial direction into the internal toothing, and which finger upon a displacement in one or the other direction of rotation is forced out of engagement with the internal toothing, whereby the pairing constituted of the internal toothing and the finger is provided with on the first pairing portion with tooth sides which are angularly symmetrical relative to the radius of the ring.

10 Claims, 2 Drawing Figures

ESCAPEMENT FOR A TIMER

BACKGROUND OF THE INVENTION

1. Field of the Invention

The present invention relates to an escapement or directional latching mechanism for a timer which actuates a timing switch component through the intermediary of a driving member, which is manually settable relative to the driving member against a larger moment of resistance in one direction of rotation as in the other direction of rotation; wherein the escapement includes a ring having an internal toothing coupled with the driving member, and a ratchet wheel connected secured fixed against rotation with the timing switch component and which is located coaxially with the ring, with the ratchet wheel including at least two arms located in the plane of the ring, which with a finger thereof engage spring-elastically in the radial direction into the internal toothing, and which finger upon a displacement in one or the other direction of rotation is forced out of engagement with the internal toothing, whereby the pairing constituted of the internal toothing and the finger is provided with on the first pairing portion with tooth sides which are angularly symmetrical relative to the radius of the ring.

2. Description of the Prior Art

An escapement or directional locking mechanism of the type considered hereinabove is described in the disclosure of German Pat. No. 29 15 526. The manual rotation of the timing switch component for time setting encounters only a low movement of resistence from the escapement, so that the manually effected time setting necessitates only a low application of force. In the opposite direction of rotation, the moment of resistance is substantially higher, so that the driving member exerts a sufficiently high drag moment on the timing switch component for the effectuation of the respective switching procedures. At a forcible rotation of the timing switch component opposite to the actual setting direction, the fingers are also displaced from engagement with the internal toothing so as to avoid the danger of damaging the escapement.

In German Pat. No. 29 15 526, the moments of resistance which are different in both direction of rotation are obtained in that two articulated connections are formed on the arm, which are at a different operative spacing relative to the finger. That type of construction of the ratchet wheel is quite complex in its actual configuration. This is also applicable when the ratchet wheel is formed as a unitary plastic component, for example, an injection-molded plastic component; in which the articulated connections are formed by a reduction of the cross-section of the arm. In this instance, the bending elasticity each of the reduced cross sectional zones must be correlated with each other. When the bending is restricted to small areas of the arm, then the plastic material in these zones tends to exhibit fatigue phenomena.

In the disclosure of German Pat. No. 28 13 069 there is described an escapement mechanism in which, during a forcible rotation or turning of the timing switch component, the latter is destroyed when rotated opposite to its actual setting direction.

SUMMARY OF THE INVENTION

Accordingly, it is an object of the present invention to provide an escapement or directional latching mechanism of the above-mentioned type, whose mode of operation affords for a simple construction of its ratchet wheel component.

The foregoing object is inventively achieved in that the second pairing component evidences includes tooth sides or flanks of which one extends at a more acute angle relative to the radius than the other, and wherein each arm exhibits the same cross-section over essentially its entire length, and in which, upon a manual displacement of the ratchet wheel member through the timing switch component in one or the other direction of rotation, the arm will bend spring elastically inwardly into itself.

The arm itself forms the spring-elastic element along its length, which presses the finger into the internal toothing. During the rotation of the timing switch component, the arm bends into one or the other direction in such a manner that the finger is displaced out of engagement with the internal toothing. Cross-sectional reductions of the arm are hereby eliminated. The arm maintains its manner of operation even at relatively large tolerances of its cross-section. Through the asymmetrical configuration of the pairing of the tooth sides or flanks there is achieved that, for the rotation of the time switch component in the one direction, there must only be overcome a substantially lower moment of resistance than for rotation in the other direction. Hereby, the larger moment of resistance is also greater than that of the necessary torque or driving moment which must be transmitted from the driving member to the timing switch component.

Preferably, the second pairing component is formed by the finger. Thus, the finger evidences a tooth side which extends at a more acute angle relative to the radius of the ring than the other side. In this instance, the sides of the teeth of the internal toothing of the ring are located symmetrical relative to the radius.

In an embodiment of the invention, each arm extends, in the unloaded condition thereof, linearly towards a chord of the ring. Hereby, the arm becomes simple in construction and can be built lengthy.

Pursuant to a further feature of the invention, there are provided three arms on the ratchet wheel, which are arranged on an equilateral triangle. This arrangement is more advantageous with respect to the encountered forces than would be a possible configuration incorporating two or four arms.

BRIEF DESCRIPTION OF THE DRAWINGS

Further advantageous embodiments of the invention can now be ascertained from the following detailed description of an exemplary embodiment thereof, taken in conjunction with the accompanying drawings; in which.

DETAILED DESCRIPTION

A ring 1 of a conventional escapement mechanism for a timer incorporates an internal toothing 2. The ring 1 is driven by the components of a clockwork mechanism (not shown in detail).

Supported coaxially with respect to the ring 1 is a ratchet wheel 3 which is connected with a time switching component (not shown in detail), so as to be secured against rotation relative thereto, which includes a clock dial or a time ring, and a time switching element associated therewith.

The diameter of the ring 1 hereby measures about 15 mm. The tooth flanks or sides 2' and 2'' are arranged to extend symmetrical relative to the radius R. The sides subtend an angle of 60° relative to each other, so as to each form an angle of 30° with the radius R.

Figure 1:
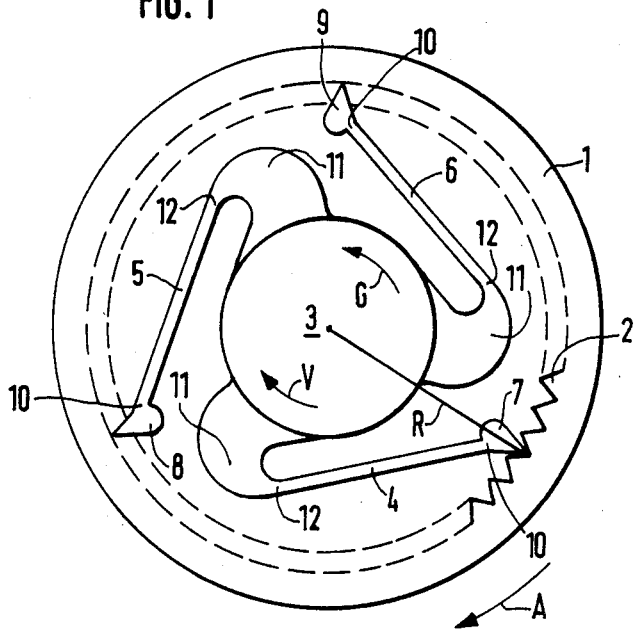
FIG. 1 illustrates a plan view of an escapement mechanism for a timer.

Formed on the ratchet wheel 3 are three arms 4, 5 and 6, which are located within the plane of the ring 1. At their free ends, the arms 4, 5 and 6 support, respectively, fingers 7, 8 and 9. The transitional regions 10 between the fingers 7, 8 and 9 and the arms 4, 5 and 6 are essentially rigid. The arms 4, 5 and 6 are linear in configuration in the unloaded condition thereof (as shown in FIG. 1). The arms extend along cords of the ring 1, and form an equilateral triangle. The arms 4, 5 and 6 each subtend an acute angle of about 45° with the radius R extending through the fingers 7, 8 and 9.

The arm 4, the arm 5, and the arm 6 are each connected by means of projections 11 with the ratchet wheel 3. The projections 11 extend from the ratchet wheel 3 in directions generally opposite to the directions of the respective fingers 7, 8 and 9. Consequently, the length of each of the arms 4, 5 and 6 is large. The projections 11 and the transitional regions 12 into which these arms 4, 5 and 6 extend, are rigid.

The arm 4, 5 or 6 which extends between the transitional regions 10, 12 evidences the same cross-section over its entire length, independently of tolerances. The cross-section is so dimensioned that each arm 4, 5 or 6 is spring-or resiliently-elastic.

Figure 2:
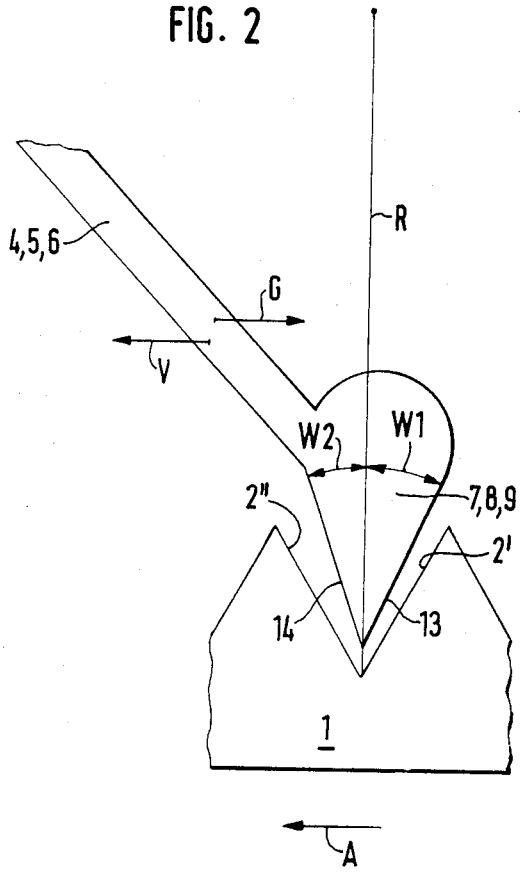
FIG. 2 is a fragmentary view of the finger segment, thereof shown on an enlarged scale.

Each finger 7, 8 or 9 includes tooth sides or flanks 13 and 14 engaging into the toothing 2. The tooth side 13 faces away from to the associated arm 4, 5 or 6. The tooth side 14 faces towards the arm. The tooth side 13 subtends an acute angle W1 with the radius R. The tooth side 14 subtends an acute angle W2 with the radius R. The angle W1 is wider than the angle W2. The tooth sides 13 and 14 extend at an angle W1+W2 with respect to each other. The angle W1 is slightly smaller than one-half of the angle which is formed by the tooth sides 2' and 2''. For example, the angle consists of 25°. The angle W2 is significantly smaller than the angle of the tooth sides 2' and 2''. For example, the angle consists of 20° (as shown in FIG. 2).

The points of the teeth 7, 8 and 9 are each offset by 120° relative to each other. In order to achieve a dampened or smooth latching action, the internal toothing 2 is so constructed that not all three tooth points will concurrently contact the bottom or root area between two tooth sides 2' and 2''. For this purpose, for example, the inner toothing 2 evidences 88 teeth.

The mode of operation of the above-described escapement mechanism is generally as follows:

When the ring 1 rotates in its driving direction A, then the tooth flanks or sides 2' strike against the tooth sides 13 of the fingers 7, 8 and 9. The ring 1 carries along the time switching component through the intermediary of the arms 4, 5 and 6 of the ratchet wheel 3. Inasmuch as the angle W1 is relatively large, by means of the ring 1 sufficiently large forces can be transmitted to the time switching component for the driving thereof. The thusly transmitted forces ,form primarily a pressure loading of the arms 4, 5 and 6, against which the latter are stable.

When the time switching component and, thereby the ratchet wheel 3, are rotated in the setting direction V, the tooth sides 14 of the fingers 7, 8 and 9 are positioned against the tooth sides 2''. Inasmuch as these paired tooth sides are oriented relatively flat with respect to each arm 4, 5 and 6, the tooth sides 14 slide along the tooth sides 2'', whereby the arms 4, 5 and 6 (viewed from externally thereof) will bend convexly. The fingers 7, 8 and 9 then glide or snap over the internal toothing 2. Since the angle W2 is relatively small, the force which is necessary for the rotation of the time switching component in the direction V, is correspondingly low. Upon termination of the rotation, the fingers 7, 8 and 9 will again engage into the internal toothing 2 under the action of the resetting force of the arms 4, 5 and 6.

When the time switching component, and thereby the ratchet wheel 3, are rotated in the opposite direction G, the tooth sides 13 come into contact against the tooth sides 2'. The arms 4, 5 and 6 are jolted and bend concavely along a portion of their length, as viewed from externally. Since the angle W1 is relatively large, the paired tooth sides 13, 2' provide a substantially greater moment of resistance in the direction G in comparison with that for the rotation in the direction V. Upon the overcoming of this moment of resistance, the tooth sides 13 slide along the tooth sides 2' so that the fingers 7, 8 and 9 will then also glide or snap over the internal toothing 2. At termination of the rotation, the fingers 7, 8 and 9 again engage into the internal toothing 2 under the resetting force of the arms 4, 5 and 6. At a superfluous rotation of the time switching component in the direction G, which at times cannot be prevented by a user, the escapement will not be damaged. Due to the more difficult rotatability of the time switching component in the direction G in contrast with that in the direction V, the user is restrained from preferably rotating the time switching component in the direction G. However, if he still rotates in the direction G, neither the ratchet wheel 3 nor the internal toothing 2 will be damaged thereby.

What is claimed is:

1. In an escapement for a timer including a driving member for actuation of a time switching component which is manually settable relative to the driving member in one direction of rotation against a larger moment of resistance than in the other direction of rotation, said escapement including a ring having an internal toothing coupled with the driving member, and a ratchet wheel arranged coaxially with the ring and being connected with said time switching component secured against rotation relative thereto, said ratchet wheel having at least two arms located in the plane of said ring, each said arm having a finger having tooth sides spring-elastically radially engaging into the internal toothing, and having an operative pairing therewith, wherein said finger is forced out of the inner toothing during displacement in one or the other direction of rotation; the tooth sides of said operative pairing being angularly symmetrical relative to the radius of the ring; the improvement comprising in that one of said pairing components includes tooth sides of which one extends at a more acute angle relative to the radius than the tooth sides of the other pairing component, each said arm having a substantially constant cross-section along the entire length thereof and which spring-elastically bends radially and inwardly responsive to a manual displacement of the ratchet wheel through the time switching component in one or the other direction of rotation.

2. Escapement as claimed in claim 1, wherein the one said pairing component is formed by said fingers.

3. Escapement as claimed in claim 1, comprising a transitional region being provided between the arm and the finger which is rigid relative to the degree of flexibility of the arm.

4. Escapement as claimed in claim 1, wherein each arm extends linearly along a chord of said ring in the unloaded condition of said arm.

5. Escapement as claimed in claim 1, wherein three arms are formed on the ratchet wheel, said arms being arranged in an equilateral triangle.

6. Escapement as claimed in claim 1, including projections on said ratchet wheel, each arm at the end remote from the finger forming a transition into a respective of said projections, each said projection being rigid relative to the arm, and extending opposite to the direction of the end of the arm supporting the finger.

7. Escapement as claimed in claim 1, the tooth side facing towards the arm is at an angle which is more acute to the radius than the tooth side facing away from the arm.

8. Escapement as claimed in claim 1, wherein, at an angle of 60° of the tooth side of the other pairing component, the more acute angle of the one said pairing component is about 20° and the more obtuse angle is about 25°.

9. Escapement as claimed in claim 1, wherein the pairing components are offset relative to each other by a fractional portion of a tooth spacing.

10. Escapement as claimed in claim 1, wherein each arm forms an acute angle with the radius extending through said finger.

* * * * *